United States Patent [19]

Cameron

[11] Patent Number: 4,579,536

[45] Date of Patent: Apr. 1, 1986

[54] FLOATING SEARCH AND RESCUE INFLATABLE PYRAMID

[76] Inventor: Robert W. Cameron, #60 Lakeshore Plz., Suite 1, Kirkland, Wash. 98033

[21] Appl. No.: 756,031

[22] Filed: Jul. 17, 1985

Related U.S. Application Data

[63] Continuation of Ser. No. 506,042, Jun. 20, 1983.

[51] Int. Cl.[4] ..... B63B 45/00

[52] U.S. Cl. ..... 441/16; 441/20; 441/28; 441/80; 114/121

[58] Field of Search ..... 441/11, 20, 37, 38, 441/40, 11, 1, 6, 12, 13, 16, 21, 28, 35, 80; 343/18 B; 114/343, 345, 121

[56] References Cited

U.S. PATENT DOCUMENTS

| | | | |
|---|---|---|---|
| 2,854,014 | 9/1958 | Hasselquist | 441/40 |
| 3,155,992 | 11/1964 | Shewmake et al. | 343/18 B |
| 3,229,290 | 1/1966 | Fisher | 343/18 B |
| 3,618,150 | 11/1971 | Anselmi | 441/16 |
| 3,883,913 | 5/1975 | Givens | 441/37 |
| 4,193,057 | 3/1950 | Bennett | 441/40 |
| 4,216,559 | 8/1980 | Switlik, Jr. | 441/40 |

FOREIGN PATENT DOCUMENTS

| | | | |
|---|---|---|---|
| 117094 | 3/1930 | Fed. Rep. of Germany | 441/40 |
| 673417 | 6/1952 | United Kingdom | 441/38 |
| 1559001 | 1/1980 | United Kingdom | 441/20 |

*Primary Examiner*—Trygve M. Blix
*Assistant Examiner*—Stephen P. Avila
*Attorney, Agent, or Firm*—Seed and Berry

[57] ABSTRACT

A pyramid constructed of upstanding inflatable beam members extending from an inflatable base upwardly to an apex. The inflatable base carries an integral sea anchor depending therefrom, comprising an inflatable cross tube carrying a centrally depending inflatable anchor tube with an achor weight positioned in the lowermost end portion thereof. The sea anchor includes a plurality of flood ports positioned in lower flat panels of flexible sheet material extending between the base and the end of the anchor tube to form a pyramidal surface enclosing the vertical anchor tube and weight. Upper flat panels of flexible sheet material extend between the upstanding inflatable beam to form a pyramidal surface. The upper panels include an upper radar reflective panel portion, a lower colored panel portion, and a translucent panel portion positioned between the upper and lower panel portions. A solar still mechanism is positioned within the enclosure formed by the pyramidal surface. Pockets are provided for survival gear on the exterior of the pyramidal surface.

16 Claims, 4 Drawing Figures

FIG. 1
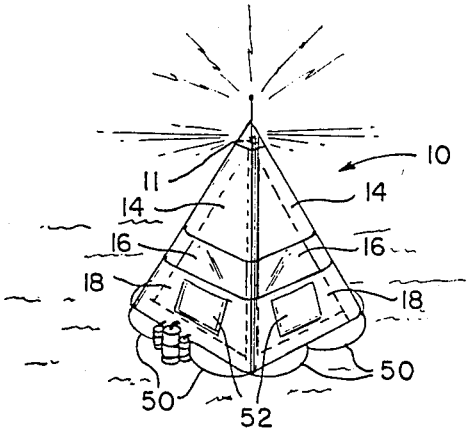
FIG. 3
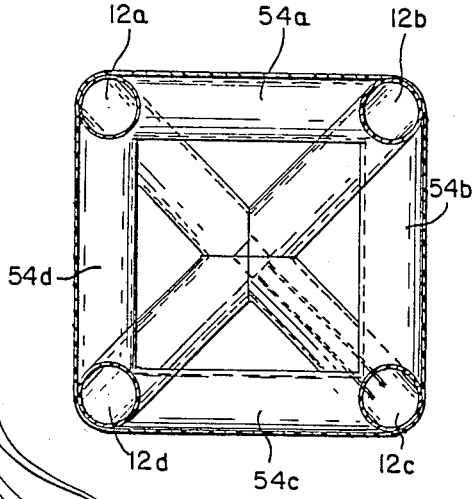
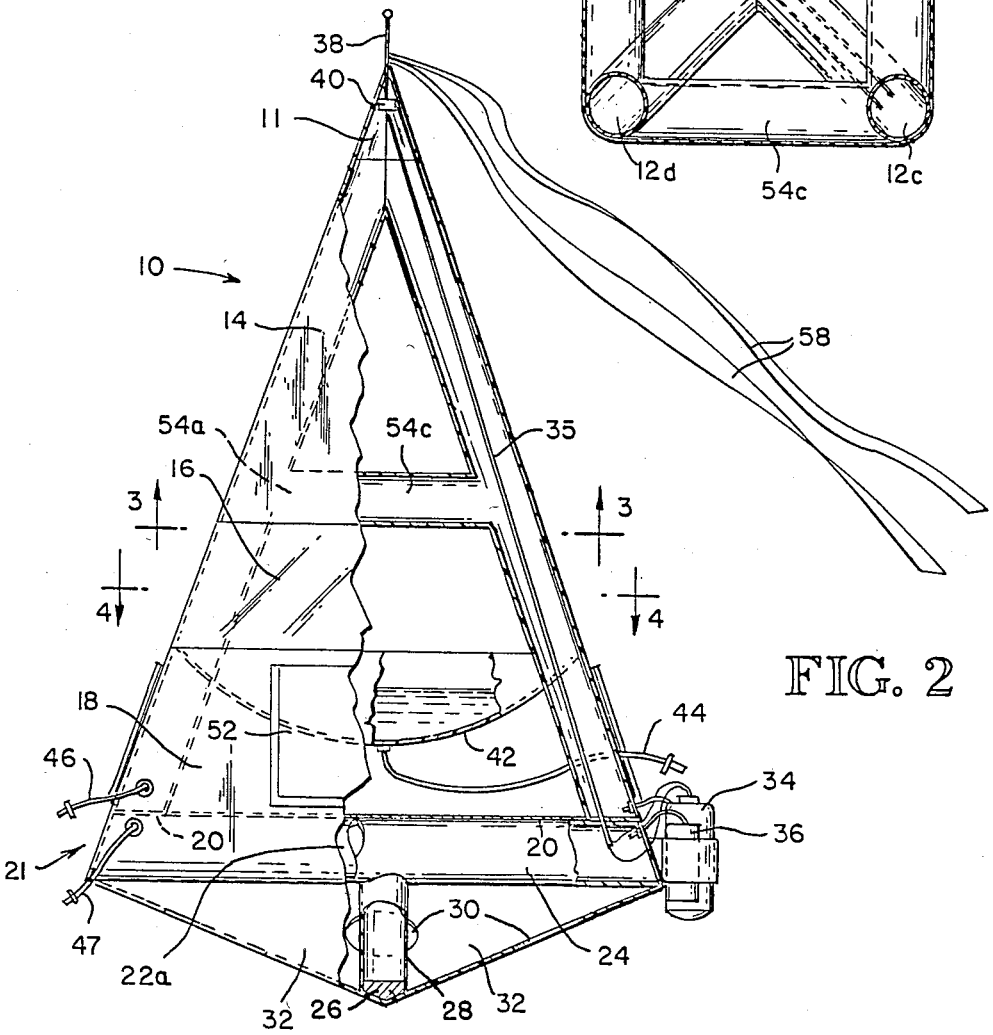
FIG. 2

FLOATING SEARCH AND RESCUE INFLATABLE PYRAMID

This application is a continuation of U.S. patent application Ser. No. 506,042, filed June 20, 1983.

DESCRIPTION

1. Technical Field

This invention relates to search and rescue devices particularly useful in marine environments and more particularly relates to a signal mechanism to aid in the search for and rescue of occupants of aircraft, boats or the like which have encountered difficulties in marine areas.

2. Background Art

It is known to use signaling mechanisms including radio signals, radar reflective devices and brightly colored fabric or plastic panels to aid in locating downed mariners or aviators. Likewise, it is well-known to use visible signals, including strobe lights, flares and the like to attract the attention of ships passing nearby in the event of a disaster at sea. Heretofore most efforts in the search and rescue equipment area have been toward providing a place for the downed mariner or aviator to crawl inside a craft such as an inflatable life raft, which may or may not be equipped with certain types of signaling mechanisms. Prior to the invention described herein, an automatically inflatable signaling mechanism having a highly visible structure with survival apparatus contained thereon has not been readily available.

DISCLOSURE OF THE INVENTION

It is an object of this invention to provide a search and rescue pyramid device which is inflatable automatically upon deployment from a water craft or aircraft and which contains signaling means as well as survival gear to aid the downed aviator or mariner.

It is another object of this invention to provide a search and rescue pyramid inflatable upon deployment which contains a solar still mechanism.

It is a further object of this invention to provide a search and rescue pyramid having an integral sea anchor to provide a mechanism which is self-righting and resistant to overturning in wind and waves.

To achieve the foregoing objects an inflatable device having a substantially conical or pryamidal shape is provided with a built-in sea anchor. The structure is constructed of a suitably lightweight yet strong and readily formed material which can be fabricated into the desired shape and configuration. Material such as MYLAR, a polyester film produced by E. I. DuPont de Nemours, Wilmington, Del., or equivalent polymer sheet material can be used. The apparatus contains a plurality of upstanding inflatable beams, a plurality of intermediate cross-beams, a separately inflatable base, together with a depending sea anchor mechanism. The upper and lower portions of the pyramid are separately inflatable by means of a self-contained carbon dioxide inflation system as well as auxiliary inflation bibs which may be operated orally by a person in the water adjacent the partially inflated pyramid or cone. The outer surface of the mechanism is adapted at its upper extremity for radar reflectivity by utilizing a MYLAR sheet suitably aluminized. The mid-section of the pyramid preferably is covered with a clear plastic sheeting material to permit the operation of an internally disposed solar still. The lower portion of the pyramid is preferably covered with a brightly colored plastic sheet such as rescue orange MYLAR. The sea anchor portion of the mechanism is equipped with a vertical air tube extending downwardly from the center of the pyramid with a lead or other heavy anchor weight disposed in the bottom of the depending air tube. A sheet material formed in a conical or pyramidal shape encloses the vertical air tube and weight and is provided with a plurality of flood ports to permit entry of water into the interior of the device, thus forming an effective sea anchor mechanism. Grasping ropes or rings are provided around the perimeter of the pyramid to permit grasping by a persons in the water adjacent the pyramid. Means for holding a plurality of survival bags or the like are provided on the exterior of the pyramid. The concept of this device precludes entry of a survivor into the inside of the pyramid but anticipates providing survival suits and the like so that a survivor may float or suspend themselves in the water adjacent the pyramid, yet avoid hyperthermia or other exposure problems for a reasonable time until rescue can be effected.

BRIEF DESCRIPTION OF THE DRAWINGS

FIG. 1 is a perspective view of the inflated floating pyramid of this invention.

FIG. 2 is a side elevational view partly cut away showing various elements of this invention.

FIG. 3 is a cross-sectional view taken along line 3—3 of FIG. 2.

BEST MODE FOR CARRYING OUT THE INVENTION

Figure 4:
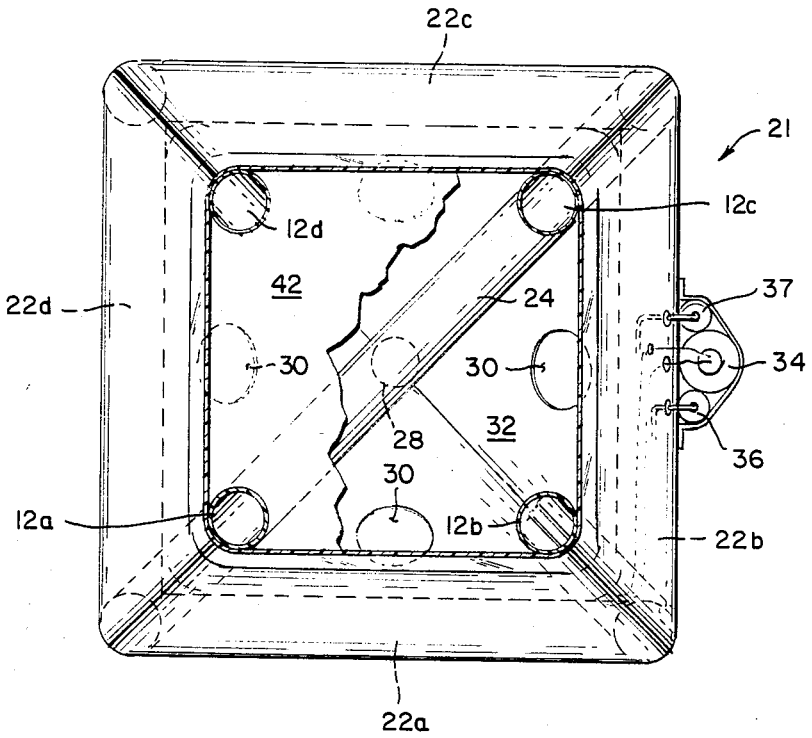
FIG. 4 is a cross-sectional view taken along line 4—4 of FIG. 2.

Referring specifically to the drawings wherein like numerals indicate like parts, there is seen one preferred embodiment of the invention which constitutes the inventor's presently preferred embodiment and best mode. The device shown in the drawings generally comprises a floating pyramid used in the search and rescue arts. Specifically, the invention comprises a plurality of inflatable upstanding beams 12(*a*), 12(*b*), 12(*c*) and 12(*d*) extending upwardly from a base formed of a comparable plurality of base tubes 22(*a*), 22(*b*), 22(*c*) and 22(*d*) which form a rectangular base. The upstanding tubes 12(*a*), 12(*b*), 12(*c*) and 12(*d*) meet at an apex shown generally at 11 and are connected together at apex 11 with air communication among the four tubes shown. Intermediate the apex 11 and base 22 there are four horizontally disposed mid-level inflatable beams 54(*a*), 54(*b*), 54(*c*) and 54(*d*) which provide additional structural rigidity to the pyramid form. Upstanding beams 12(*a*), 12(*b*), 12(*c*) and 12(*d*) are connected to but pneumatically sealed from the based beams 22(*a*), 22(*b*), 22(*c*) and 22(*d*) by a seal wall 20 positioned at the lower end of each of said upstanding inflatable beams. The seal wall 20 serves to isolate the base 22 from the upstanding beams 12(*a*), 12(*b*), 12(*c*) and 12(*d*) to give two separate air chambers as is further described below.

As is best seen in FIG. 4, which is a plan view in cross-section taken along lines 4—4 of FIG. 2, there is a cross tube 24 extending diagonally across the base formed by tubes 22(*a*), 22(*b*), 22(*c*) and 22(*d*). Cross tube 24 pneumatically communicates with the base 21 and is inflated simultaneously with the foregoing base tubes and is positioned as shown to provide a mounting location for anchor tube 28. In FIG. 2 anchor tube 28 is shown extending downwardly from cross tube 24 with an anchor weight 26 positioned at the bottom-most portion thereof. The anchor tube 28 together with panels 32 constitute a sea anchor which may be flooded through sea anchor flood ports 30. Having anchor weight 26 positioned as shown causes the device to be self-righting under most circumstances when inflated.

The search and rescue pyramid is equipped with a dual inflation system as is best shown in FIG. 4. $CO_2$ supply cartridges 36 and 37 are provided to inflate the upper and lower portions of the apparatus upon deployment. The cylinders are sized so that the volume of carbon dioxide necessary to fully inflate both the upper and lower inflatable portions of the apparatus is provided. Auxiliary inflation means are also provided to enable a person in the water to further inflate the apparatus via oral inflation tube 46 provided for the upper section and oral inflation tube 47 provided for the lower segment of the device. By this mechanism additional inflation can be provided as necessary.

The pyramid structure may be equipped with numerous signaling and safety devices. An emergency radio system which is activated automatically upon deployment may be used as is shown at numeral 34 in the drawings. For example, a model RLB-14 ACR EP1RB radio having a range of 200 to 300 miles operating in a frequency of 121.5 mhz and 243.0 mhz broadcasting a variable audio sweep from 1300 to 300 hz in accordance with RTCA may be used. A magnesium battery pack with a storage life of six years is preferably supplied although other power sources well-known in the art may be utilized. The radio broadcast through antenna 38 positioned at the top of the pyramid and is connected to radio 34 via antenna wire 35.

In addition, a strobe light 40 positioned in a clear pyramidal section of the top of the pyramid 43 permits the transmission of a strobe, such as ACR/SM-2 U.S. Coast Guard approved strobe 161.0101610 high intensity xenon strobe 360 degrees with a life of up to 50 hours. The strobe is similarly activated upon deployment with well-known mechanism.

Radar reflective MYLAR streamers 58 may conveniently be attached to the peak of pyramid 10. Aluminized MYLAR is an effective radar reflective material.

The upper portion of the pyramid, save the clear pyramidal section 11, is covered with a radar reflective MYLAR or equivalent material for form reflective panels 14. The mid-section of the pyramid is covered with a translucent material to form translucent panels 16 for a purpose described further below. The lower portion of the pyramid is covered with colored panels 18, such as the widely used international orange or similar highly visible coloring.

Positioned within the interior of the pyramid is a solar still mechanism, including collector 42 and water withdrawal tube 44. The clear panel 16 permits energy from the sun to operate a solar still in a well known-fashion.

Provision is made for a person in the water to hang onto the inflated floating pyramid by means of safety ropes 50 which are attached at strategic locations around the perimeter of the floating pyramid at or near the water line. These ropes can be used to cling to the device or can be placed beneath the arms of a person floating in the water to provide support and protection to the individual. Protective devices such as inflatable survival suits or the like may be contained in pockets 52 positioned at strategic locations around the exterior of the inflated pyramid. Other appropriate survival gear may similarly be located on or in the pyramid structure.

The apparatus described above is normally stowed folded in a container on an aircraft or boat. Whenever the mechanism is needed, for example upon a crash of an airplane or the sinking of a water craft, the search and rescue pyramid can be deployed by opening the container for the folded device and activating the automatic inflation mechanism of the $CO_2$ supply cartridges for the upper and lower portions of the pyramid. Automatically operational devices analogous to the well-known mechanisms for deploying life rafts can be utilized if desired. At the time of deployment, the radio 34 and the strobe light 40 would be activated. The inflatable beams, namely 12(*a*), 12(*b*), 12(*c*) and 12(*d*), together with the base inflatable structure 22(*a*), 22(*b*), 22(*c*) and 22(*d*), would be automatically inflated by the carbon dioxide supply cartridges 36 and 37, respectively. Due to the presence of the anchor weight 36, the device would immediately assume an upright position as shown in FIG. 1 and the bottom of the mechanism would become a sea anchor flooded through ports 30. Due to the shape of the pyramid, high winds would have a lesser effect on the device than other shapes. As wind blows against one of the triangular side segments, the pyramid would merely bend and dump the wind much in the manner of a sail being luffed.

In compliance with the patent statutes, the invention has been described in language more or less specific as to structural features. It is to be understood, however, that the invention is not limited to the specific features shown, since the means and construction herein disclosed comprise only a presently preferred form of putting the invention into effect. the invention is, therefor, claimed in any of its forms or modifications within the legitimate and valid scope of the appended claims, appropriately interpreted in accordance with the doctrine of equivalents.

I claim:

1. A pyramid-shaped floating search and rescue inflatable signal device, comprising:

four endwise connected generally horizontally disposed inflatable base tubes defining a generally rectangularly shaped base;

a generally horizontally disposed inflatable cross-tube connected to and extending diagonally between two of the four corners of said base defined by the interconnection of said base tubes;

an inflatable anchor tube centrally positioned along said cross-tube and connected thereto, said anchor tube extending downwardly from said cross-tube and having a free lower end portion supportably containing therein a ballast weight, said ballast weight having sufficient weight and said anchor tube extending downward sufficiently far to cause the device to be resistant to overturning in the water from wind and waves during use and to cause the device to be self-righting if overturned in the water during deployment or subsequent use;

four inflatable frame tubes, each connected by one end to one of the four corners of said base and extending upwardly therefrom to an apex at which the other ends of said frame tubes are connected together;

four flat upper panels of flexible sheet material, each extending between adjacent ones of said frame tubes and said base tubes to form an upper pyramidal surface;

four flat lower panels of flexible sheet material, each extending between one of said base tubes in the lowermost end of said anchor tube and joined along its common edges with the adjacent lower panels to form a lower pyramidal surface enclosing said anchor tube and ballast weight therein, said lower panels having flood ports for restricted entry and exit of water from the interior space defined by said lower pyramidal surface, said base tubes, cross-tube, anchor tube and frame tubes collectively having sufficient buoyancy and said ballast weight having sufficient weight to maintain said upper pyramidal surface generally above the water and said lower pyramidal surface generally below the water.

2. The device of claim 1 further including two generally horizontally disposed inflatable mid-frame tubes, each being connected by its opposing end to diagonally opposing ones of said frame tubes at a midportion of said frame tubes between the upper and lower ends thereof, each mid-frame tube crossing the path of and being connected to the other of said mid-frame tubes for providing lateral structural support for said frame tubes.

3. The device of claim 1 further including grasping means attached to the outside perimeter of the device in the area of said base for grasping by a person in the water.

4. The device of claim 1 further including pockets for survival gear attached to the exterior of said first pyramidal surface.

5. The device of claim 1 wherein said panels of said first pyramidal surface include an upper radar reflective panel portion and a lower translucent panel portion, and wherein the device further includes a solar-still mechanism positioned within the enclosure formed by said first pyramidal surface and positioned to receive light through said translucent panel portion.

6. The device of claim 5 wherein said panels of said first pyramidal surface further include a colored panel portion positioned below said translucent panel portion.

7. The device of claim 6 wherein said colored panel portion is also radar reflective.

8. The device of claim 6 wherein said panels of said first pyramidal surface further includes an upper translucent panel portion positioned above said upper radar reflective panel portion and the device further includes a strobe light positioned within the enclosure to transmit a signal light through said upper translucent panel portion.

9. The device of claim 1 further including means for automatically inflating said base tubes, cross-tubes, anchor tube and frame tubes upon deployment of the device in the water.

10. The device of claim 1 wherein said frame tubes are internally interconnected for simultaneous inflation.

11. The device of claim 1 wherein said base tubes, cross-tube and anchor tube are internally interconnected for simultaneous inflation.

12. The device of claim 1 wherein said apex includes radio transmitting and strobe light means.

13. The device of claim 1 wherein auxiliary inflation means are provided for inflation of the device orally by the user.

14. The device of claim 1 further including radar reflective streamers attached to and extending from said apex.

15. A non-personnel carrying floating search and rescue inflatable signal device, comprising:

an inflatable base having a plurality of generally horizontally disposed inflatable base tubes extending about the central vertical flotation axis of the device;

a generally horizontally disposed inflatable cross-tube connected to and extending between said base tubes through the vertical axis of the device;

an inflatable anchor tube connected to said cross-tube substantially at the vertical axis of the device, said anchor tube extending downwardly from said cross-tube substantially along the vertical axis of the device and having a lowermost end portion supporting a ballast weight, said ballast weight having sufficient weight and said anchor tube extending downward sufficiently far to cause the device to be resistant to overturning in the water from wind and waves during use and to cause the device to be self-righting if overturned in the water during deployment or subsequent use;

a plurality of inflatable frame tubes, each connected by one end to said base tubes and extending upwardly therefrom to an apex at which the other ends of said frame tubes are connected together;

flat upper panels of flexible sheet material, each extending between adjacent ones of said frame tubes and said base tubes to form an upper enclosure surface, said panels having at least a portion thereof which is radar reflective sized to provide sufficient radar cross-section for detection by rescuers; and flat lower panels of flexible sheet material, each extending from one of said base tubes to substantially said lowermost end of said anchor tube to form a lower enclosure surface, said lower panels having flood ports therein, said base tubes, cross-tube, anchor tube and frame tubes collectively having sufficient buoyancy and said ballast weight having sufficient weight to maintain said upper enclosure surface generally above the water and said lower enclosure surface generally below the water, the device being sufficiently small in size that the buoyancy thereof and the interior space defined by said upper enclosure surface are insufficient to carry personnel therein.

16. A non-personnel carrying floating search and rescue inflatable signal device, comprising:

an inflatable base having a generally horizontally disposed inflatable base tube substantially extending fully about the central vertical flotation axis of the device;

a generally horizontally disposed inflatable cross-tube connected to and extending between opposing portions of said base tube through the vertical axis of the device;

an inflatable anchor tube connected to said cross-tube substantially at the vertical axis of the device, said anchor tube extending downwardly from said cross-tube substantially along the vertical axis of the device and having a lowermost end portion supporting a ballast weight, said ballast weight having sufficient weight and said anchor tube extending downward sufficiently far to cause the device to be resistant to overturning in the water from wind and waves during use and to cause the device to be self-righting if overturned in the water during deployment or subsequent use;

a plurality of inflatable frame tubes spaced around said base tube, each connected by one end to said base tubes and extending upwardly therefrom to an apex at which the other ends of said frame tubes are connected together;

an upper sheet of flexible material, extending between adjacent ones of said frame tubes and said base tube to form an upper enclosure surface, said panel having at least a portion thereof which is radar reflective sized to provide sufficient radar cross-section for detection by rescuers; and a lower sheet of flexible material, extending around and from said base tube to substantially said lowermost end of said anchor tube to form a lower enclosure surface, said lower sheet having flood ports therein, said base tube, cross-tube, anchor tube and frame tubes collectively having sufficient buoyancy and said ballast weight having sufficient weight to maintain said upper enclosure surface generally above the water and said lower enclosure surface generally below the water, the device being sufficiently small in size that the buoyancy thereof and the interior space defined by said upper enclosure surface are insufficient to carry personnel therein.

* * * * *